US010005113B2

(12) United States Patent
Cernuschi et al.

(10) Patent No.: US 10,005,113 B2
(45) Date of Patent: Jun. 26, 2018

(54) ROLLING STAND FOR TUBES OR ROUNDS

(71) Applicant: Danieli & C. Officine Meccaniche S.P.A., Buttrio (IT)

(72) Inventors: Ettore Cernuschi, Castelletto Sopra Ticino (IT); Fabio Lacapruccia, Milan (IT); Gianluca Bazzaro, Codroipo (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 203 days.

(21) Appl. No.: 14/348,506

(22) PCT Filed: Sep. 28, 2012

(86) PCT No.: PCT/EP2012/069175
§ 371 (c)(1),
(2) Date: Mar. 28, 2014

(87) PCT Pub. No.: WO2013/045604
PCT Pub. Date: Apr. 4, 2013

(65) Prior Publication Data

US 2014/0230513 A1 Aug. 21, 2014

(30) Foreign Application Priority Data

Sep. 29, 2011 (IT) ..... MI2011A1754

(51) Int. Cl.
*B21B 27/02* (2006.01)
*B21B 1/16* (2006.01)
*B21B 17/00* (2006.01)

(52) U.S. Cl.
CPC ..... *B21B 27/024* (2013.01); *B21B 1/16* (2013.01); *B21B 17/00* (2013.01); *B21B 2267/06* (2013.01)

(58) Field of Classification Search
CPC ... B21B 27/024; B21B 27/02; B21B 2267/06; B21B 1/16; B21B 17/00; B21B 17/02; B21B 17/04; B21B 17/14; B21B 23/00
(Continued)

(56) References Cited

U.S. PATENT DOCUMENTS 3,842,635 A 10/1974 Bibighaus
4,607,511 A * 8/1986 Shore ..... B21B 37/48 72/12.7

(Continued)

FOREIGN PATENT DOCUMENTS

EP 1637242 A1 3/2006
EP 1707281 A1 4/2006

(Continued)

OTHER PUBLICATIONS

Machine Translation of FR1192488, translated Aug. 15, 2017, 11 Pages.*

*Primary Examiner* — Teresa M Ekiert
*Assistant Examiner* — Gregory Swiatocha
(74) *Attorney, Agent, or Firm* — Stetina Brunda Garred & Brucker

(57) ABSTRACT

A rolling stand for tubes or rounds comprising two or more rolls defining a rolling section of the rolling stand that is coaxial to a rolling axis Y of the same stand, each roll having a respective rolling surface defining a respective straight line of symmetry passing through the rolling axis and through the center of symmetry of the respective surface, thus determining a first half and a second half of the respective surface. The rolling stand also including two gap zones having a radial distance from the rolling axis and a groove bottom zone having a radial distance from the rolling axis at the intersecting point of the respective surface with the respective straight line of symmetry, the rolling stand providing, for each roll on said respective rolling surface, at (Continued)

least one first pushing zone and at least one second pushing zone.

7 Claims, 10 Drawing Sheets

(58) Field of Classification Search
USPC ..... 72/95, 252.2
See application file for complete search history.

(56) References Cited

U.S. PATENT DOCUMENTS

| | | | | |
|---|---|---|---|---|
| 2008/0289391 | A1* | 11/2008 | Okui | B21B 17/14 72/234 |
| 2009/0266132 | A1* | 10/2009 | McDonald | B21H 1/20 72/235 |
| 2013/0205860 | A1* | 8/2013 | Yamane | B21B 17/04 72/224 |

FOREIGN PATENT DOCUMENTS

| | | | | |
|---|---|---|---|---|
| FR | 1192488 | A * | 10/1959 | B21B 13/103 |
| JP | 07047410 | A * | 2/1995 | |
| JP | 10-156412 | | 6/1998 | |
| RU | 2008180 | | 2/1994 | |
| SU | 956080 | | 9/1982 | |

* cited by examiner

ROLLING STAND FOR TUBES OR ROUNDS

CROSS REFERENCE TO RELATED APPLICATIONS

The present application claims priority to PCT International Application No. PCT/EP2012/069175 filed on Sep. 28, 2012, which application claims priority to Italian Patent Application No. MI2011A001754 filed Sep. 29, 2011, the entirety of the disclosures of which are expressly incorporated herein by reference.

STATEMENT RE: FEDERALLY SPONSORED RESEARCH/DEVELOPMENT

Not Applicable.

BACKGROUND OF THE INVENTION

Field of the Invention

This invention relates to a rolling stand for calibrating or reducing rolling mill with multiple rolls for tubes made of steel or other metal.

State of the Art

Calibrations made with known calibrating or reducing rolling mills for steel tubes or rounds have the feature of having an ovalization of the outer surface intended as ratio between the space left free for the body being processed in the zone of the gap between the adjacent rolls, since that zone is usually also called gap zone, generally indicated with H2, and the space left free for the body being processed at the groove bottom zone of the roll, generally indicated with H1. This happens at each roll, irrespective of how many rolls the stand is currently made of, for example 2, 3, or 4 rolls.

According to the prior art, the angular sector of the roll comprised between the groove bottom zone and the gap zone has a distance H(α) increasing as a function of α, α being the angle with the central vertex on the rolling axis Y and having line B as a side passing by the bottom zone of the roll. FIG. 1 shows an example of four-roll calibrating rolling stand of the prior art.

The rolling mills of this type are normally of the multi-stand type, wherein the stands are in a succession along the rolling axis Y, with decreasing calibration section making sure that the groove bottom zones of the stands in odd positions match the gap zones of the stands in even positions and the groove bottom zones of the stands in even positions match the gap zones of the stands in odd positions, irrespective of the number of rolls making up each stand.

In the general case, the working sector of each roll is equal in degrees to αroll=360°/NR where NR indicates the number of rolls per stand.

Therefore, for stands with 2 rolls, the working sector has an angular width αroll=360°/2=180°, for 3 roll stands αroll=360°/3=120°, for 4 roll stands αroll=360°/4=90°, and so on as NR increases.

Accordingly, the offset angle between odd and even stands becomes β=αroll/2, i.e.

for 2 roll stands β=180°/2=90°, for 3 roll stands β=120°/2=60°, for 4 roll stands β=90°/2=45°.

FIG. 2 shows the case of two consecutive stands of the prior art projected on the same section plane, with NR=3, offset by angle β=60°.

FIG. 3 shows a quadrant of the cross section of a rolling roll with a stretch S of the roll surface in a polar reference system and FIG. 4 shows the pattern of the same surface S of the roll in a projection in a Cartesian axis reference system. Therefore, the function representing the calibration profile Rpass=H(α) is generally an even function with a relative minimum for α=0° and a maximum value in the gap zone.

The last stand of the rolling mill usually has a perfectly round section to eliminate any shape defects in the tube or round section that may be found after the passage of the tube or round in the previous stands.

Rolling practice and theoretical simulations confirm that the material squeezed radially towards the center by the groove bottom zones of the rolls of each stand tends to overfill in the gap zones. This trend is more marked as the number of rolls per rolling stand decreases and the ratio between nominal diameter and thickness of the tube wall increases. In particular, it has been seen that with the recent introduction of four roll stands in the rolling mills, the material of the tube pushed towards the center Y along four directions angularly offset at 90° from each other tends, on the other hand, to shrink also in the gap zones. This phenomenon is easily understood since the angular sector comprised between one push point and the next one in the circumference direction is reduced and therefore, the material of the tube or round is more guided during the deformation thereof.

The prior art rolling mills generally provide for a more oval-like calibration set, i.e. with larger ratios H2/H1 for thin tubes and smaller H2/H1 for large tubes, which forces to have a large number of calibration roll sets available, increasing the cost of a rolling mill.

Document U.S. Pat. No. 3,842,635 discloses a rolling stand with three rolls for the cold rolling of tubes by means of a mandrelmandrel. Each roll of the stand has two relative minimums of the roll surface radius at an angle Φ measured by the line passing by the groove bottom zone of the roll and by the rolling axis. Such groove profile is recommended for reducing rolls that must be in any case followed by finishing rolls that completely transform the section of the outer surface of the tubes which takes on a complex, non-circular shape, for example triangular or hexagonal. This document does not address the problem of achieving a perfectly circular final section tube shape.

An attempt of making the final profile of a rolled tube more circular at the end of a sequence of thickness reductions preventing the forming of a polygonal inner section of the tube and the elimination of overfilling in the gap zones has been made in patent EP1707281 discloses a solution with a succession of rolling stands with rolls having the groove profile with a variable radius which increases starting from a minimum radius at the line passing by the groove bottom zone by the rolling axis. The radius increases gradually or in portions up to reaching the maximum at the gap. In practice, the theoretical contact between the roll bottom and the outside of the roll is arranged at the groove bottom. In this solution there is only one relative minimum of the radius of the roll groove surface. This profile has a bending always directed towards the same side along the whole groove profile. This solution seems more suitable when the tubes have a thicker wall while it is not optimal for rolling tubes with a thinner wall.

While these solutions offer final tube sections that achieve high quality, they do not always meet the market requirements that requires top quality rolled material, such as tubes and rounds, with as small number of reduction and calibration stands as possible.

SUMMARY OF THE INVENTION

The object of the invention is to provide a rolling stand for tubes or rounds that makes the shape of the rolled tube or round more homogeneous and that serves for making complete trains of rolls as short as possible.

Another object of the invention is to ensure the same rolling quality also using rolling stands having a smaller number of rolls and with a larger ratio between nominal diameter and tube wall thickness.

This and other objects are achieved by a rolling stand for tubes or rounds which, according to claim 1, comprises two or more rolling rolls defining a rolling section of the rolling stand that is coaxial to a rolling axis of the rolling stand, each roll having a respective rolling surface defining a respective straight line of symmetry passing through the rolling axis and through the center of symmetry of the respective surface, thus determining a first half and a second half of the respective surface, two gap zones having a radial distance of value H2 from the rolling axis and a groove bottom zone having a radial distance of value H1 from the rolling axis at the intersecting point of the respective surface with the respective straight line of symmetry, characterized in that it provides, for each roll on said respective rolling surface, at least three pushing zones, of which a first pushing zone is circumferentially arranged on the respective straight line of symmetry, a second pushing zone is circumferentially arranged in the first half of the respective surface between the respective groove bottom zone and the adjacent gap zone, at an angular distance of value $\alpha R$ from the respective straight line of symmetry, and a third pushing zone, circumferentially arranged in the second half of the respective surface between the respective groove bottom zone and the adjacent gap zone, at an angular distance of value $\alpha L$ from the respective straight line of symmetry.

According to the invention, the intermediate pushing zones between straight line of symmetry and gap zone, which may be in a variable number, are always next to the pushing zone that remains at the groove bottom, i.e. where $\alpha=0°$, in any embodiment.

The rolling stand of the invention uses the principle of reducing the angular distance between two consecutive pressure points along the circumference of the rolling section, in order to make the tube deformation more homogeneous on the surface thereof. Having a number of pushing points below three like in known prior art solutions does not allow the same rolling quality level to be achieved since the pushing points remain too far away from each other.

The advantages technology-wise are clear since with calibrations of this type it is not necessary anymore to have a rolling mill with separate calibration shapes for tubes with thick walls and for tubes with thin walls, the nominal diameter being equal.

A further advantage resulting from the increase in the number of pushing points is that normally, due to the unevenness of the deformation, a polygonal shape is created within the tube with a number of sides equal to twice the number of pushing points. A hexagon is therefore formed for rolling mills with 3 rolls per stand and traditional calibrations. The inner polygonal shape effect is more evident for very thick tubes. Therefore, the larger the number of polygonal sides, the more the polygon shape resembles a circle.

BRIEF DESCRIPTION OF THE DRAWINGS

Further features and advantages of the invention will appear more clearly from the detailed description of preferred but non exclusive embodiments of a rolling stand, illustrated by way of a non-limiting example with the aid of the accompanying drawing tables, wherein.

DETAILED DESCRIPTION OF THE INVENTION

According to the present invention, FIGS. 5 to 8 show two embodiments of rolling stand with three rolls having different shapes of the rolling surface.

The first version of rolling stand comprises the three calibration rolls 10, 20, 30, i.e. with NR=3, perfectly equal to each other, each having a rolling surface S1. The shape of this rolling surface S1 according to the invention may be represented by curve $Rpass=H(\alpha)$, i.e. as a function of the distance between the rolling axis Y as angle $\alpha$ changes, which is an even function with three points 1, 2, 3 of relative minimum NP located in the zones determined by the following angular values α, respectively, measured by the straight line B passing by the rolling axis Y and by the median point of the surface of roll 10 so as to form the axis of symmetry for the two halves of surface S1 wherein angle α has value 0°:

$\alpha L=-(360°/3)/NR\pm5°$ $\alpha 1=0°$ $\alpha R=-\alpha L$.

Figure 1:
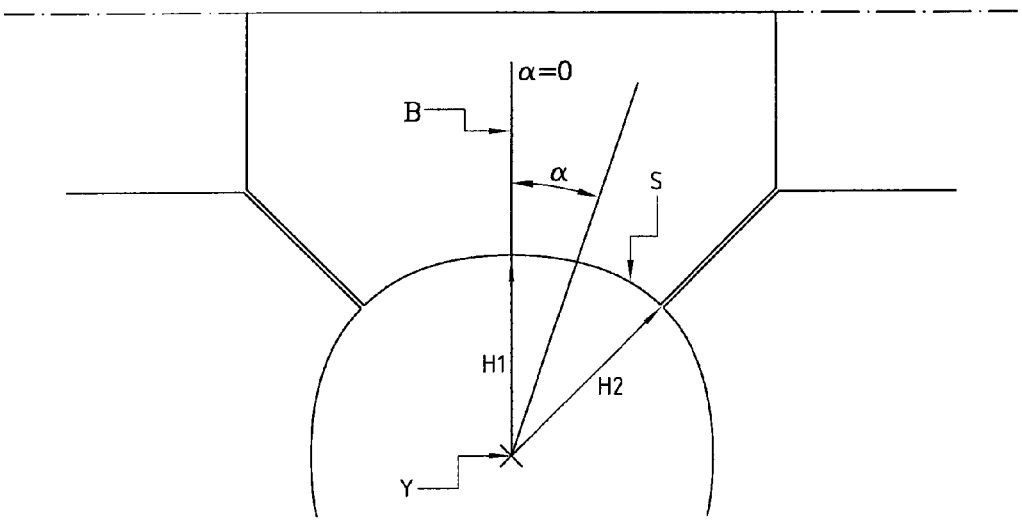
Fig. 1 (Prior Art)
FIG. 1 shows a section orthogonal to the rolling axis Y of a 4-roll rolling stand of the prior art.
Figure 2:
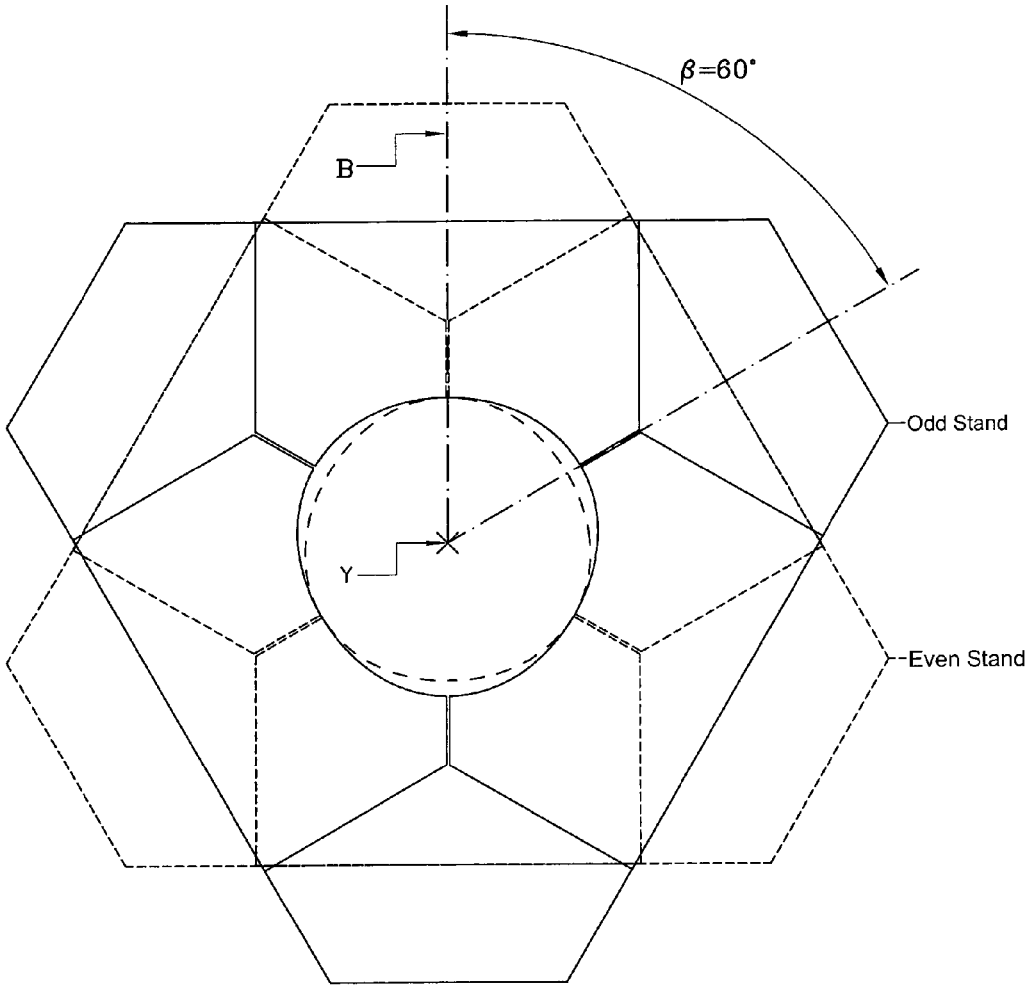
Fig. 2 (Prior Art)
FIG. 2 shows a section orthogonal to the rolling axis Y downstream of a rolling stand in odd position and with a rolling stand in even position of the prior art in the background.
Figure 3:
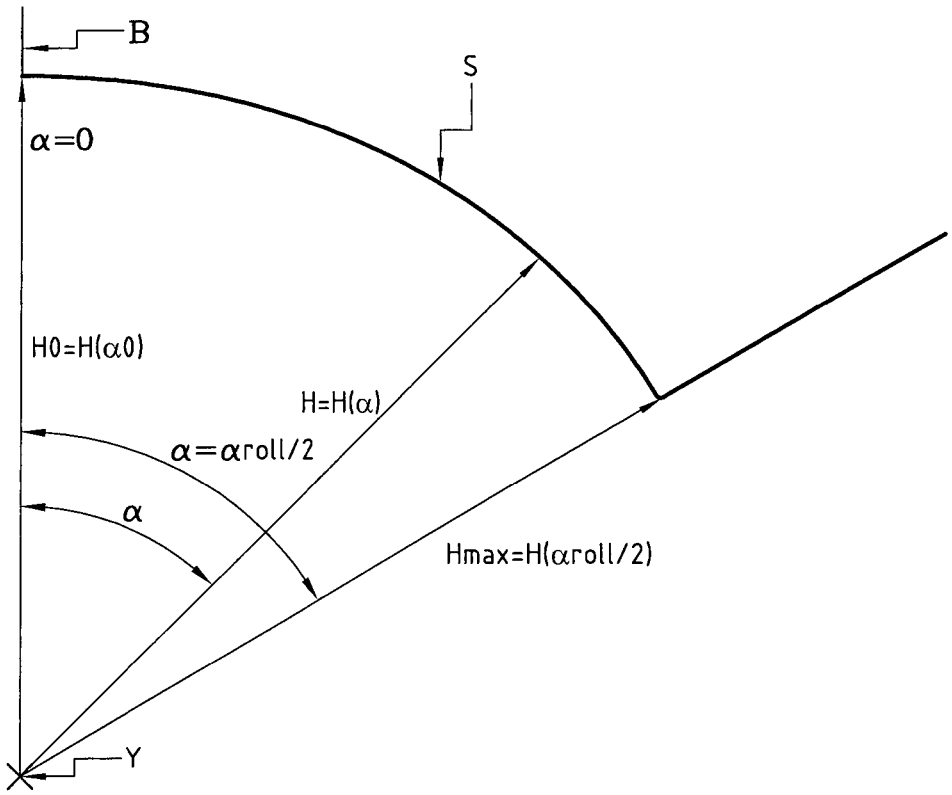
Fig. 3 (Prior Art)
FIG. 3 shows an enlarged section view of an angular sector of a rolling stand of the prior art.
Figure 4:
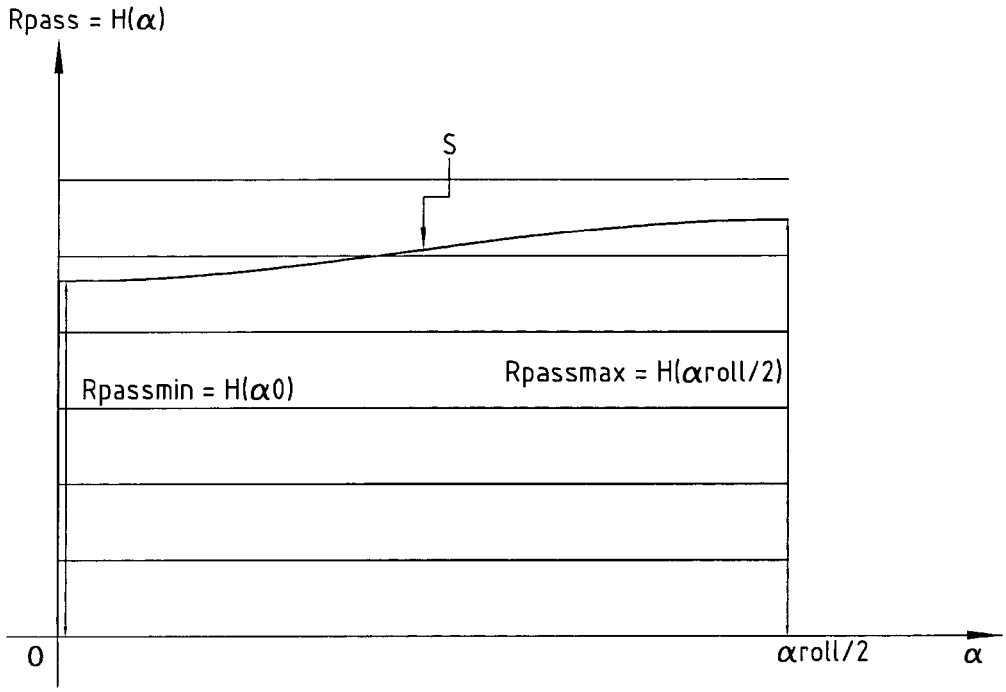
Fig. 4 (Prior Art)
FIG. 4 shows a diagram showing the curve of the rolling surface of the sector of FIG. 3 projected in a Cartesian axis reference system.
Figure 5:
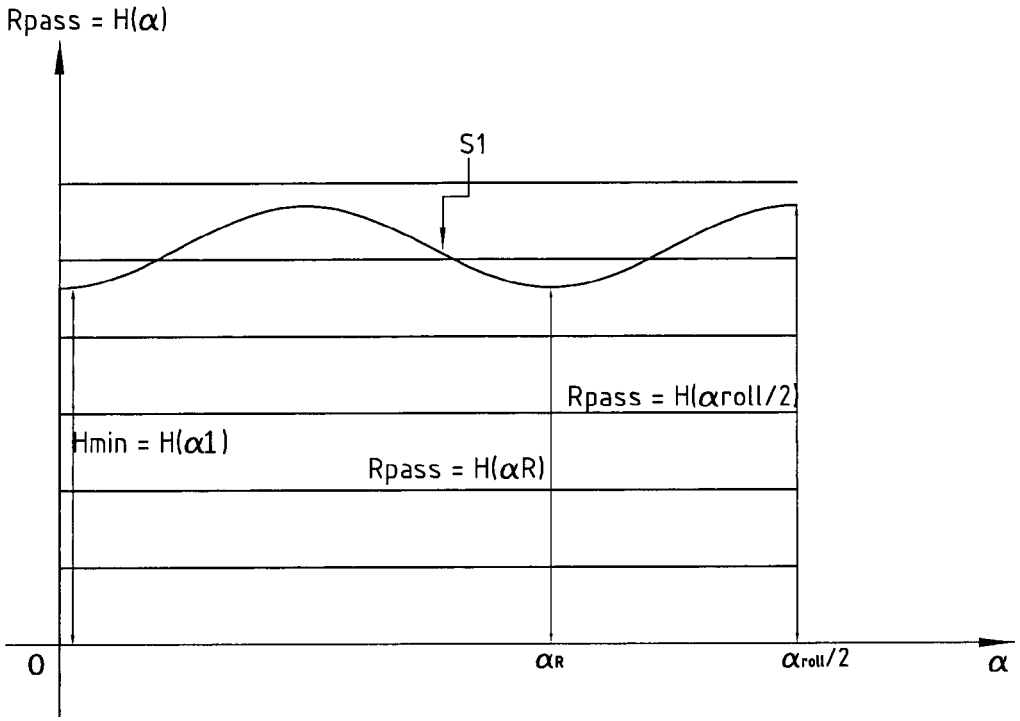
FIG. 5 shows a diagram showing a stretch of the curve of the rolling surface S1 projected in a Cartesian axis reference system of a roll of a rolling stand according to a first embodiment of the invention.

These values are shown, in projection is a Cartesian axis system, along the curve of FIG. 5, only showing half of surface S1 of roll 10, the other half being equal to and perfectly symmetrical with this curve with respect to the ordinate axis where $\alpha=\alpha_1=0°$.

At least three points of relative minimum NP are required on the roll surface to achieve the advantages of the invention. Translating this condition in mathematical terms means that it is necessary for the derivative of function $R(\alpha)/\alpha$ to change sign 6 times on the entire profile. It is clear that what is described for roll 10 is repeated in the same way for the other rolls 20, 30 of the rolling stand.

Figure 6:
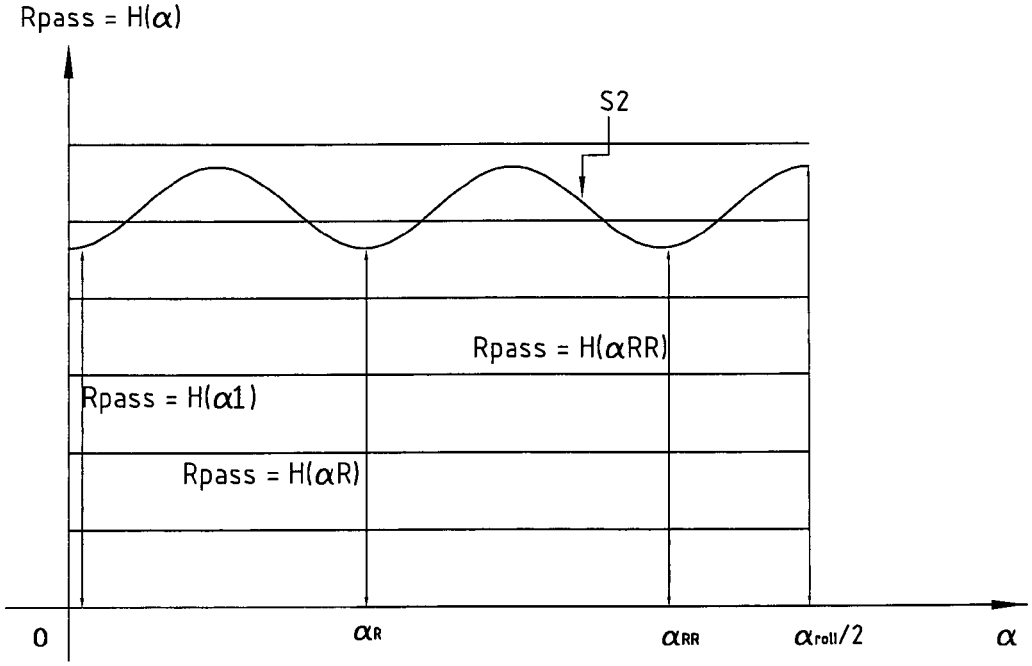
FIG. 6 shows a diagram showing a stretch of the curve of the rolling surface S2 projected in a Cartesian axis reference system of a roll of a rolling stand according to a second embodiment of the invention.

The second embodiment of rolling stand comprises the three rolls 11, 21, 31, each having a rolling surface S2. Since in this case five minimum points (NP=5) are provided, there are five pushing zones 1', 2', 3', 22', 33' on the tube or round to be rolled for each roll. This is equivalent to the condition that the derivative of function $R(\alpha)/\alpha$ changes sign 10 times along the entire profile. At these zones, which can be only ideally approximated as points while they actually are contact surfaces, there are relative minimums of curve Rpass circumferentially arranged in zones of surface S2 corresponding to the following angular values, respectively:

$\alpha LL=-(360°*2/NR)/5\pm5°$ $\alpha L=-(360°/NR)/5\pm5°$ $\alpha 1=0$ $\alpha R=-\alpha L$ $\alpha RR=-\alpha LL$ These values are shown on the curve of FIG. 6 in projection on a Cartesian axis system but only for a half of surface S2, the other half being perfectly similar and therefore not shown.

The generalization of this formula for determining a number of minimum points NP larger than five, i.e. for the cases in which the derivative of function $R(\alpha)/\alpha$ changes sign more than 10 times along the entire profile, on the rolling surface S2 for each roll, therefore is:

$\alpha 1=-[360°*(NP-1)/2]*(1/NR)*(1/NP)$ $\alpha 2=\alpha 1+(360°/NR)/NP$ $\alpha 3=\alpha 2+(360°/NR)/NP$ . . . and for a generic number K $\alpha K=\alpha(K-1)+(360°/NR)/NP$.

The possible change in position of the barycenter of each pushing zone by +/−5° has not been highlighted in the general formula for simplicity, the barycenter of each zone corresponding to the ideal point representing the whole zone, and such point in the schematic drawings has been given as nominal position of each zone. It is in any case understood that also in this occasion a displacement of the respective barycenter of the minimum zones by +/−5° is possible, considering the actual distance between two adjacent minimum zones.

Figure 7:
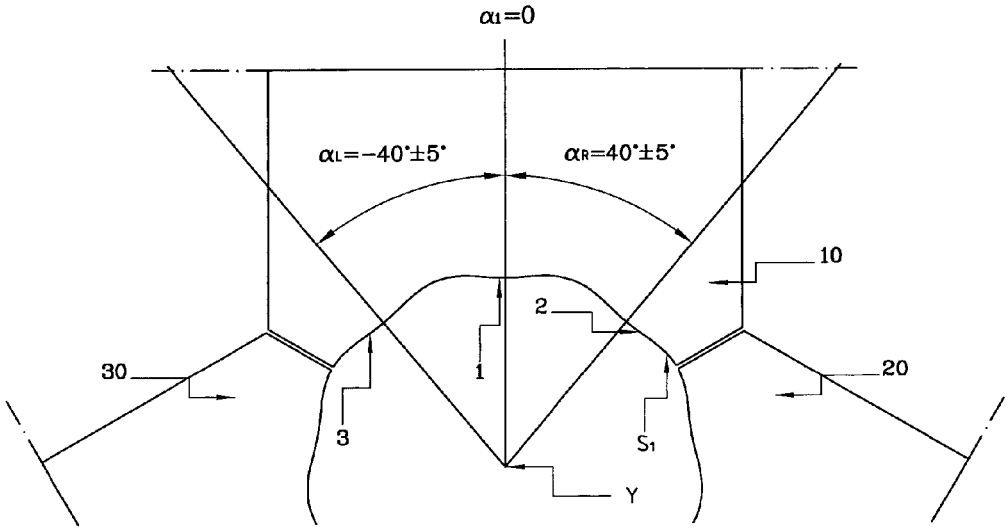
FIG. 7 shows a partial section transversal to the rolling axis Y of a first version of a 3-roll stand with roll surface corresponding to the curve of FIG. 5 according to the invention.

Summarizing what described above, the pressure zones will nominally be, i.e. unless there is a change by an angle comprised in the range between +5° and −5°, in the following combinations shown in FIGS. 7, 8, 9, 10:

In FIG. 7 with a three-roll stand wherein each roll has three pushing zones 1, 2, 3 positioned with respect to the straight line of symmetry B at angles α=−40°, 0°, 40°.

Figure 8:
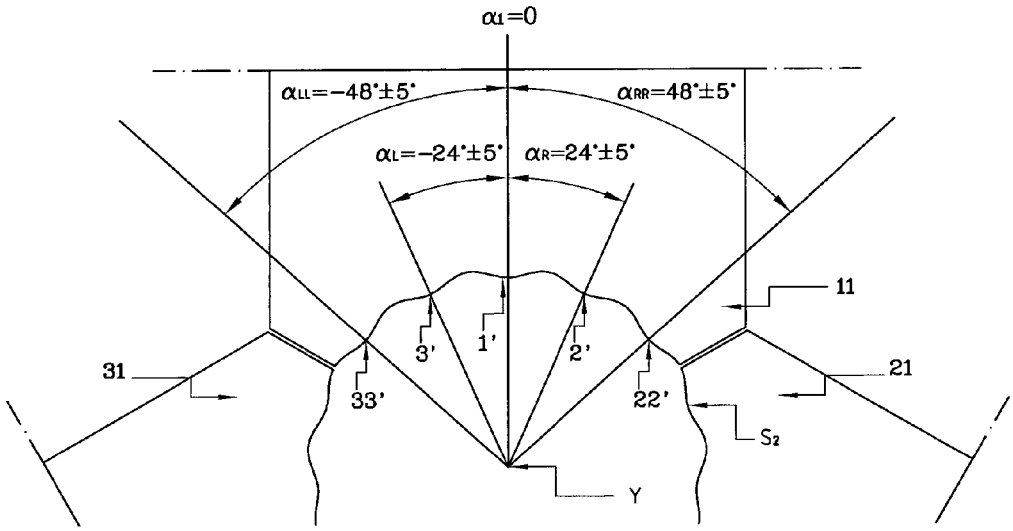
FIG. 8 shows a partial section transversal to the rolling axis Y of a second version of a 3-roll stand with roll surface corresponding to the curve of FIG. 6 according to the invention.

In FIG. 8 with a three-roll stand wherein each roll 11, 21, 31 has five pushing zones 1', 2', 22', 3', 33' positioned with respect to the straight line of symmetry B at angles α=−48°, −24°, 0°; 24°, 48°.

Figure 9:
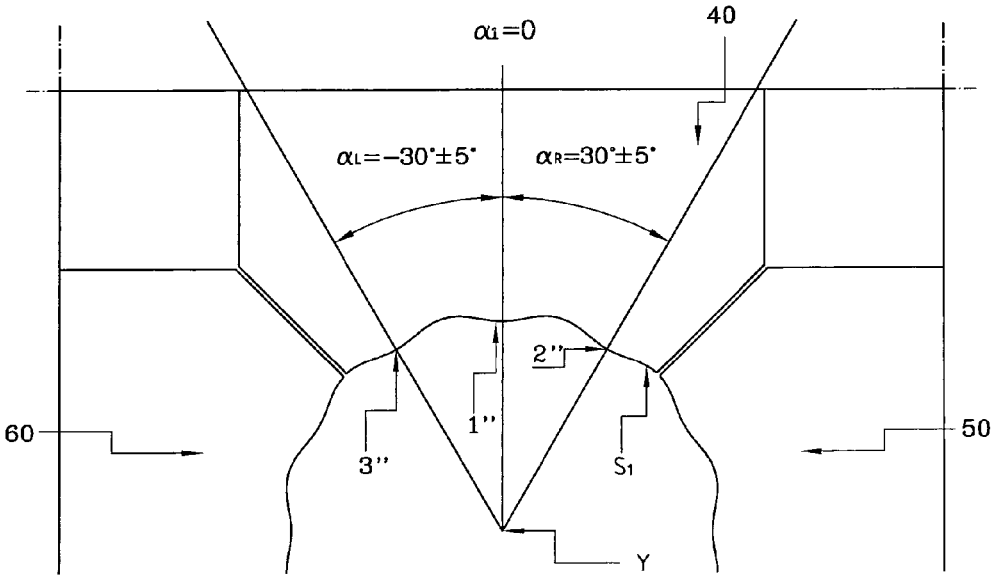
FIG. 9 shows a partial section transversal to the rolling axis Y of a first version of a 4-roll stand with roll surface corresponding to the curve of FIG. 5 according to the invention.

In FIG. 9 with a four-roll stand 40, 50, 60 wherein each roll has three pushing zones 1", 2", 3" positioned with respect to the straight line of symmetry B at angles α=−30°, 0°, 30°.

Figure 10:
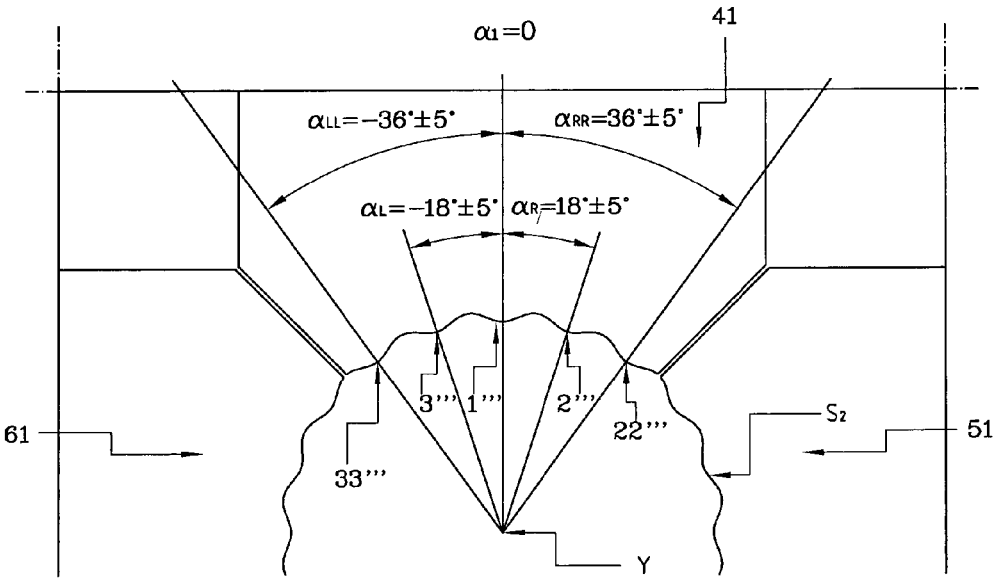
FIG. 10 shows a partial section transversal to the rolling axis Y of a second version of a 4-roll stand with roll surface corresponding to the curve of FIG. 6 according to the invention.

In FIG. 10 with four-roll stand 41, 51, 61 wherein each roll has five pushing zones 1''', 2''', 3''', 22''', 33''' positioned with respect to the straight line of symmetry B at angles α=−36°, −18°, 0°, 18°, 36°.

In FIGS. 9 and 10 wherein the stand has NR=4, the fourth roll is not shown but has a shape perfectly symmetrical to the upper roll, indicated with 40 and 41 respectively.

The values of HL or HLL and HR or HRR preferably but not necessarily are equal to value H1 of the groove bottom.

Figure 11:
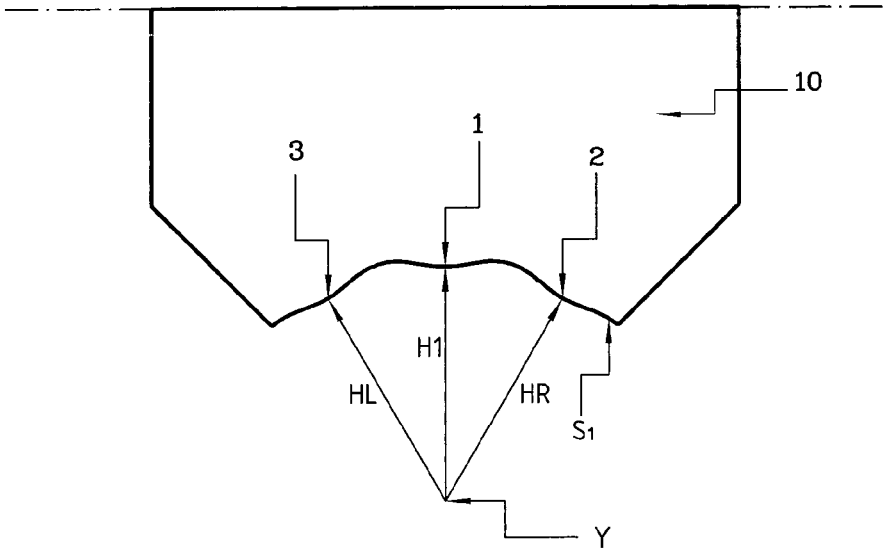
FIG. 11 shows a section of a roll of a 4-roll stand with rolling surface having a first profile variant according to the invention.
Figure 12:
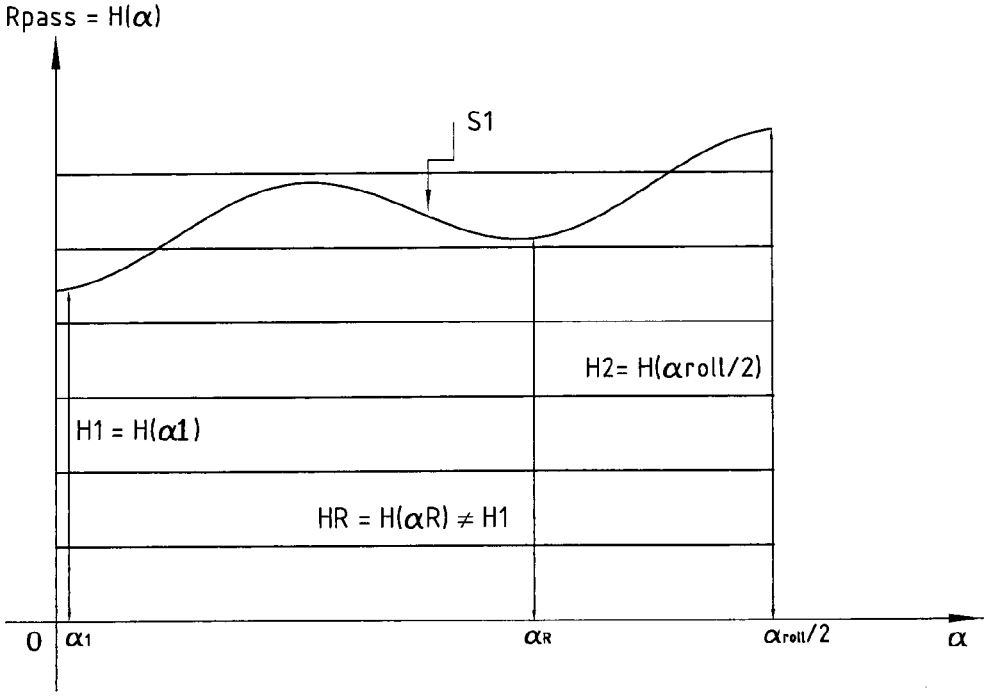
FIG. 12 shows a diagram showing half of the curve of the rolling surface S1 projected in a Cartesian axis reference system of the roll of FIG. 11.

The corresponding FIGS. 11 and 12 show a roll 10 of the version of the invention with rolls having three pushing zones, NP=3, wherein HR≠H1. Symmetrically, HL≠H1 applies to the other half of the roll surface with three pushing points.

In this way, for example, in this version there is a total of 9 pressure points on each stand, distributed every 40°, is arranged in nominal position, for stands with NR=3 (see FIG. 7). In the zone corresponding to the gap zone or gap H2, the value of Rpass will be higher than the two pressure points located in αL and αR adjacent to the same gap. This is the case of the embodiment of FIG. 12.

Likewise, for four-roll stands there is a total of 12 pressure zones distributed every 30°, considering the nominal position thereof. In the zones corresponding to the gap zone or gap H2, the value of Rpass is higher than the two pressure points located in αL and αR adjacent to the same gap.

Figure 13:
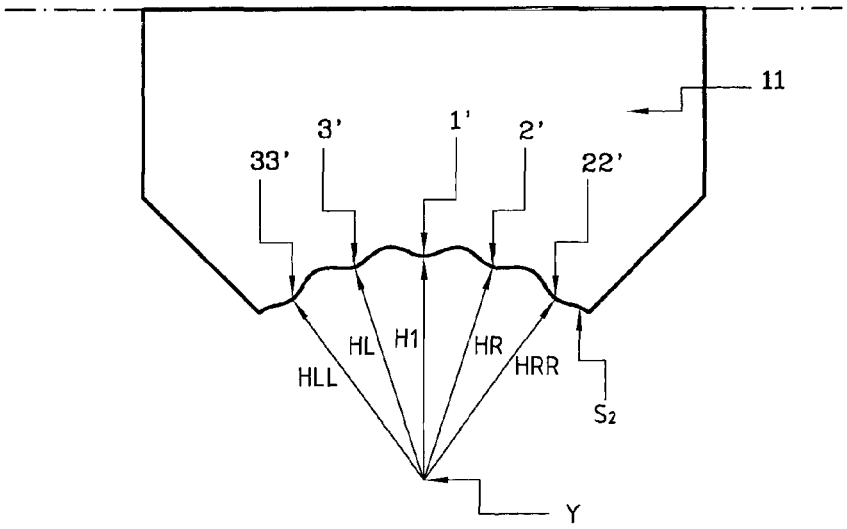
FIG. 13 shows a section of a roll of a 4-roll stand with rolling surface having a second profile version according to the invention.
Figure 14:
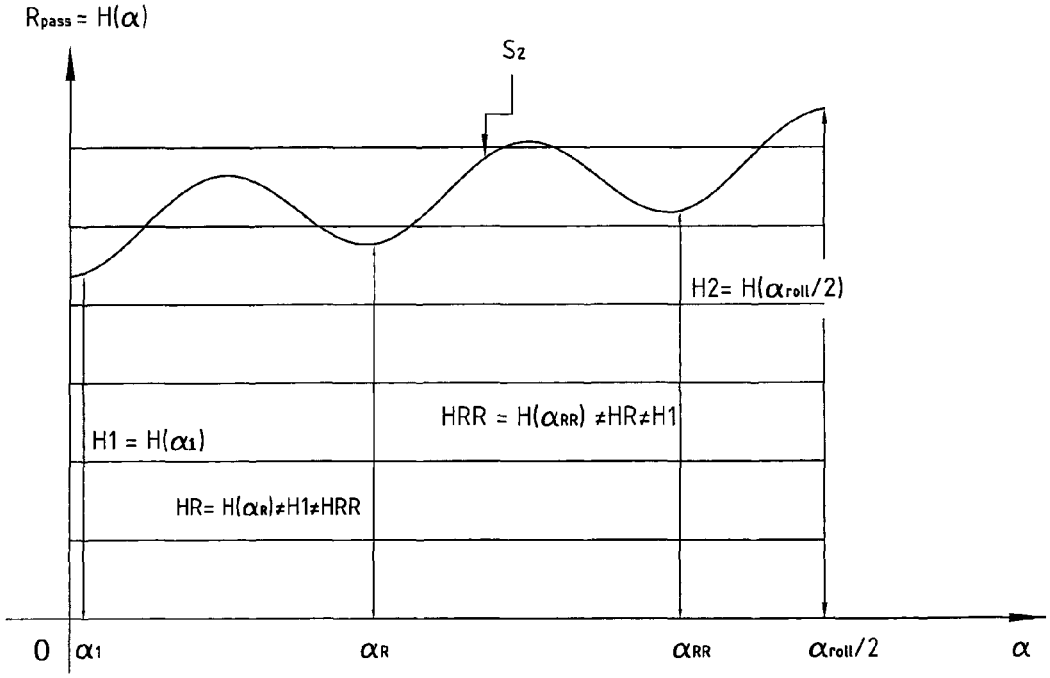
FIG. 14 shows a diagram showing half of the curve of the rolling surface S2 projected in a Cartesian axis reference system of the rolling roll of FIG. 13.

For the version shown in FIGS. 13 and 14, where roll 11 with five pushing zones is shown, NP=5, the values HL≠HLL≠H1 are for a half of the surface of each roll, whereas symmetrically for the other half of the roll surface we have HR≠HRR≠H1.

With the various distributions described above related to number of pressure zones NP and number of rolls NR for a stand in any position, the pressure zones of the next stand are automatically in an intermediate position with respect to those of the previous stand, allowing the correct reduction of diameter.

Figure 15:
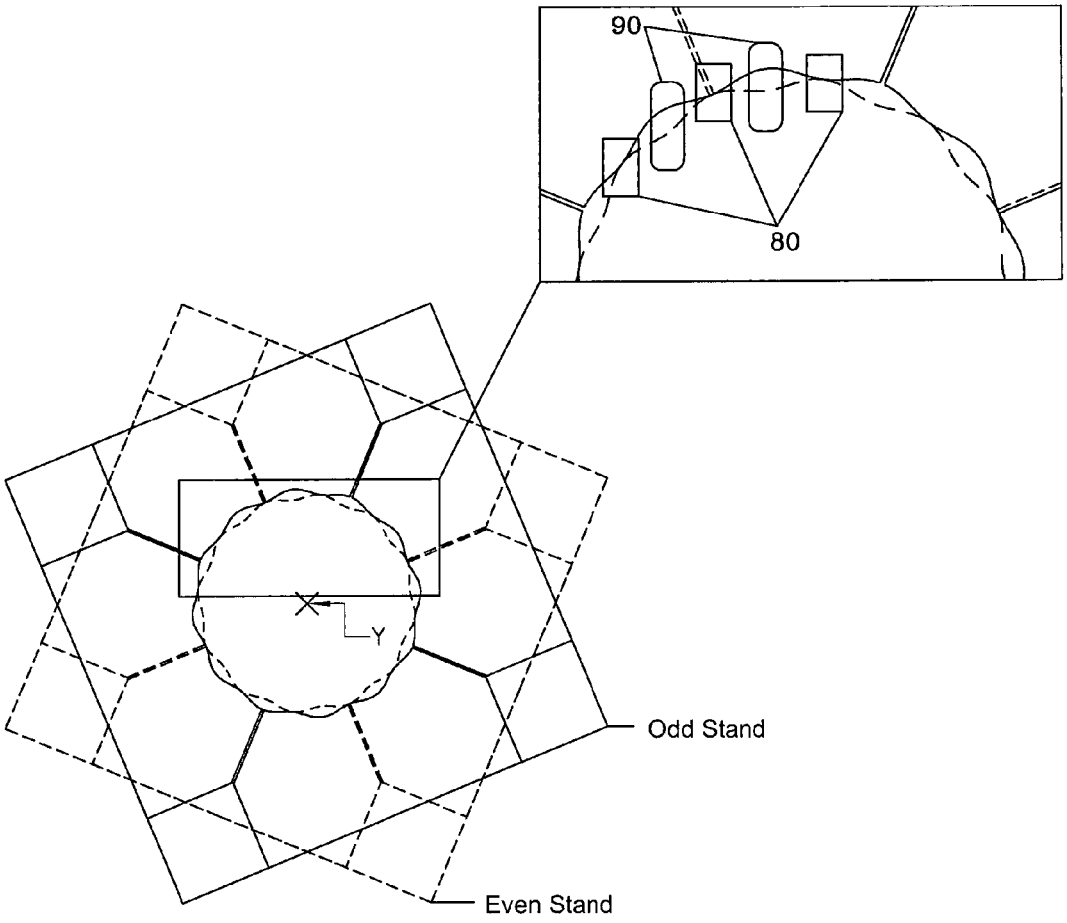
FIG. 15 shows a section orthogonal to the rolling axis Y downstream of a rolling stand in even position and with a rolling stand in odd position in the background according to the invention.

FIG. 15 shows a section of a rolling mill made at a rolling stand. e.g. a stand in even position in the foreground and a second rolling stand in the background, e.g. an odd position stand. In this version, the rolling stands have NR=4 rolls and NP=3 pushing points per roll. Reference numeral 80 indicates the pushing zones on the rolled material of the odd stand whereat even, non-pushing zones in the stand are located. On the contrary, reference numeral 90 indicates the zones wherein the stand in odd position does not push the rolled material and whereat the pushing zones of the stand in even position are located. The concept shown in the figure may be extended likewise to all the rolls for rolling mills having numbers of rolls NR e and number of pressure zones NP as desired.

The ovality of the rolled material with the profiles of the rolls according to the invention is smaller compared to traditional calibrations with one pressure point. The stiffness features of the section for the material being processed and the continuity of the rolled material in axial direction allow a shrinking in radial direction also in the zones not in contact with the roll. In fact, such sudden changes in the concavity cannot be followed by the material. This implies alternating contact zones between roll and rolled material in the direction of angle α, preventing the material of the tube or round to penetrate into the gap zones which notoriously leave marks on the outer surface of the rolled material.

The advantage of a calibration with a rolling mill comprising stands according to the invention therefore is that the tube remains less oval since the material is pushed almost radially in a large number of points evenly distributed along the perimeter of the calibration section, in the zones between one pressure point and the next one the material is pushed towards the center and therefore tends to not fill the calibration profile shape, in any case preventing the penetration in the gap zones between one roll and the next one with consequent surface defects.

Such phenomenon allows the calibrations to be made even for large and thin thicknesses, in particular for the version of stand with four rolls per stand and where the distance between one pressure point and the next one and the next one is limited to 30°, corresponding to the case of NP=3.

In all of the cases described above, also a stand for the final calibration with perfectly round section is provided at the end of the train of rolls which comprises rolling stands according to the invention.

The invention claimed is:

1. A rolling mill for tubes or rounds, comprising:

two or more rolling stands for tubes or rounds, each of the two or more rolling stands comprising three or more rolling rolls defining a rolling section of the rolling stand that is coaxial to a rolling axis of the rolling stand, each roll having:

a respective rolling surface defining a respective straight line of symmetry passing through the rolling axis and through a center of symmetry of the respective surface thus determining a first half and a second half of the respective surface, two gap zones having a radial distance of value H2 from the rolling axis, each gap zone being located at an adjacent roll, and a groove bottom zone having a radial distance of value H1 from the rolling axis at an intersecting point of the respective surface with the respective straight line of symmetry, wherein there are provided, for each roll on said respective rolling surface, at least five alternating pushing zones which push the tubes or rounds, a first pushing zone of which is arranged on the respective straight line of symmetry at said groove bottom zone, a second pushing zone is circumferentially arranged in the first half of the respective surface between the respective groove bottom zone and the adjacent gap zone, at an angular distance of value αR from the respective straight line of symmetry, a fourth pushing zone is circumferentially arranged in the first half of the respective surface between the respective groove bottom zone and the adjacent gap zone, at an angular distance of value αRR from the respective straight line of symmetry, a third pushing zone is circumferentially arranged in the second half of the respective surface between the respective groove bottom zone and the adjacent gap zone, at an angular distance of value αL from the respective straight line of symmetry, and a fifth pushing zone is circumferentially arranged in the second half of the respective surface between the respective groove bottom zone and the adjacent gap zone, at an angular distance of value αLL from the respective straight line of symmetry;

and wherein, at each of said at least five pushing zones, there is a point of relative minimum of a curve Rpass=H(α) representing the shape of the rolling surface along a plane orthogonal to the rolling axis, where H(α) is the radial distance of the rolling surface from the rolling axis in function of the angular distance a from the respective straight line of symmetry; and an end rolling stand with a round rolling section.

2. The rolling mill according to claim 1, wherein said second pushing zone, has a radial distance having value HR from the rolling axis and said third pushing zone has a radial distance of value HL from the rolling axis, and wherein said values HR and HL are equal to or greater than the value H1 and less than the value H2.

3. The rolling mill according to claim 2, wherein the angles αR and αL have an equal value to one another.

4. The rolling mill according to claim 1, wherein the angles αR αL have an equal absolute value to one another and the angles αRR, αLL have an equal absolute value to one another.

5. The rolling mill according to claim 1, comprising five rolling rolls.

6. The rolling mill according to claim 1, comprising three rolling rolls.

7. The rolling mill according to claim 1, comprising four rolling rolls.

* * * * *